US006119398A

United States Patent [19]

Yates, Jr.

[11] Patent Number: 6,119,398

[45] Date of Patent: Sep. 19, 2000

[54] TILT WINDOW BALANCE SHOE ASSEMBLY WITH THREE DIRECTIONAL LOCKING

[76] Inventor: H. Dale Yates, Jr., 6999 Oakland Rd., Loveland, Ohio 45140

[21] Appl. No.: 09/186,083

[22] Filed: Nov. 5, 1998

[51] Int. Cl.[7] ..... E05D 15/22; E05D 15/24; E05F 3/16

[52] U.S. Cl. ..... 49/181; 49/176; 49/445

[58] Field of Search ..... 49/181, 176, 445, 49/446, 447

[56] References Cited

U.S. PATENT DOCUMENTS

| | | | |
|---|---|---|---|
| 3,844,066 | 10/1974 | Nobes . | |
| 4,068,406 | 1/1978 | Wood . | |
| 4,452,012 | 6/1984 | Deal | 49/181 |
| 4,590,708 | 5/1986 | Campodonico | 49/181 |
| 4,683,676 | 8/1987 | Sterner, Jr. . | |
| 4,854,077 | 8/1989 | Rogers et al. | 49/322 |
| 4,958,462 | 9/1990 | Cross | 49/181 |
| 5,127,192 | 7/1992 | Cross | 49/181 |
| 5,210,976 | 5/1993 | Cripps . | |
| 5,237,775 | 8/1993 | Hardy . | |
| 5,301,467 | 4/1994 | Schmidt et al. | 49/181 |
| 5,371,971 | 12/1994 | Prete . | |
| 5,377,384 | 1/1995 | Riegelman | 16/193 |
| 5,383,303 | 1/1995 | Nakanishi et al. . | |
| 5,414,960 | 5/1995 | O'Donnell et al. . | |
| 5,697,188 | 12/1997 | Fullick et al. | 49/181 |
| 5,704,165 | 1/1998 | Slocomb et al. | 49/181 |
| 5,806,243 | 9/1998 | Prete et al. | 49/181 |
| 5,829,196 | 11/1998 | Maier | 49/181 |

*Primary Examiner*—Daniel P. Stodola
*Assistant Examiner*—Gregory J. Strimbu
*Attorney, Agent, or Firm*—Charles R. Wilson

[57] ABSTRACT

A tilt window balance shoe assembly is used with a double hung window and provides three directional locking. The balance shoe assembly comprises a slide block, a center cam, a pair of brake shoes, and a locking lug. The slide block has a head portion with a retention slot for a balance mechanism and a generally cylindrical-shaped hole which receives the center cam. The slide block also has side apertures extending to the hole and a receiving opening in a back face of the slide block and extending to the hole. The center cam has a slot well, cam flats and cam rounds. The slot well receives a terminus of a pivot bar attached to the window. The brake shoes which are positioned in the side apertures and the locking lug which is positioned in the receiving opening are in operable association with the center cam. Tilting of the window about its lower pivot point causes the pivot bar to rotate the center cam. Upon rotation of the center cam, the brake shoes and locking lug move from a window moving position to a window locked position wherein the brake shoes and the locking lug frictionally engage the window frame of the window. The resultant three directional locking force is very effective for preventing the sash window from unintentionally sliding in the window frame.

15 Claims, 5 Drawing Sheets

TILT WINDOW BALANCE SHOE ASSEMBLY WITH THREE DIRECTIONAL LOCKING

FIELD OF THE INVENTION

This invention relates to a balance shoe assembly. More particularly, the invention relates to a tilt window balance shoe assembly to provide enhanced window locking.

BACKGROUND OF THE INVENTION

Windows for use primarily in residential structures are available in different styles. Double hung windows, casement windows and slide windows have been installed in many homes for many years. Double hung windows in particular are very popular. They comprise a lower sash window and an upper sash window. The two sash windows are mounted to move vertically alongside one another. More modern double hung windows are also mounted to tilt inwardly about a lower pivot point. This allows access to an exterior surface of the glass for ease of cleaning purposes.

A substantial effort has been expended to create a reliable balance, lock and tilt mechanism for use with the above mentioned double hung windows with tilt capability. The mechanism must allow the sash windows to move up and down with minimal effort by the homeowner. Each of the window sashes must have the capability of remaining at a desired height on its own. The sash windows must also be able to tilt inwardly at any desired window height position. Examples of mechanisms to accomplish the above purposes can be found in U.S. Pat. Nos. 3,844,066, 4,068,406, 4,683,676, 5,210,976, 5,237,775, 5,371,971, 5,383,303 and 5,414,960.

A problem with known balance, lock and tilt mechanisms for double hung sash windows is that the locking or braking action of the mechanisms is less than desired. The homeowner who has tilted one of the sash windows inwardly expects the window to remain in place. Without adequate locking, the window can slide downwardly to create an inconvenience. Also, a certain degree of inadvertent downward force by the homeowner onto the window while cleaning is expected. Known mechanisms provide the locking by friction forces of a brake shoe against the window frame. Different camming actions have been used, all causing a component to move into friction engagement with a surface of the window frame. However, given the size limitations of the mechanisms, necessarily brake shoes have minimal surface areas for friction contact. As a result, known double hung sash windows are prone to moving even after a locking force has been applied and set.

In accord with a need in the original and replacement window industry, there has now been developed a balance shoe assembly with enhanced locking action. The balance shoe assembly is economical to produce. It is adapted for use with commonly used balance mechanisms and in conventional window frames. Most importantly, the balance shoe assembly provides a locking force in excess of those systems presently available.

SUMMARY OF THE INVENTION

A tilt window balance shoe assembly is for use with a double hung window. The assembly is used in a slide track of a window frame to provide three directional locking of the sash window within the window frame. The balance shoe assembly comprises a slide block, a center cam, a set of brake shoes, and a locking lug. The slide block has a head portion with a retention slot to receive a balance mechanism and has a generally cylindrical-shaped centered hole to receive the center cam. The hole extends from a front face of the sliding block to a back face of the sliding block. The slide block also has side apertures extending to the centered hole and a receiving opening on its back face extending to the centered hole. The center cam has a slot well, cam flats and cam rounds. The slot well is to receive a terminus of a pivot bar. Brake shoes which are positioned in the side apertures and the locking lug positioned in the receiving opening are in operable association with the center cam. Tilting of a sash window about its lower pivot point causes the pivot bar to rotate the center cam. Upon rotation of the center cam, the brake shoes and locking lug move from a sash window moving position to a sash window locking position. The brake shoes exert a friction force in direct opposite directions to one another and the locking lug exerts a friction force transverse to the brake shoe forces. The resultant three directional locking force is very effective.

DETAILED DESCRIPTION OF THE INVENTION

The balance shoe assembly of the invention is described in detail in the following paragraphs and with reference to the drawings. The shoe assembly is useful with virtually any size or shape of double hung window. The sash window frame can be wood, vinyl or have a clad construction.

Figure 1:
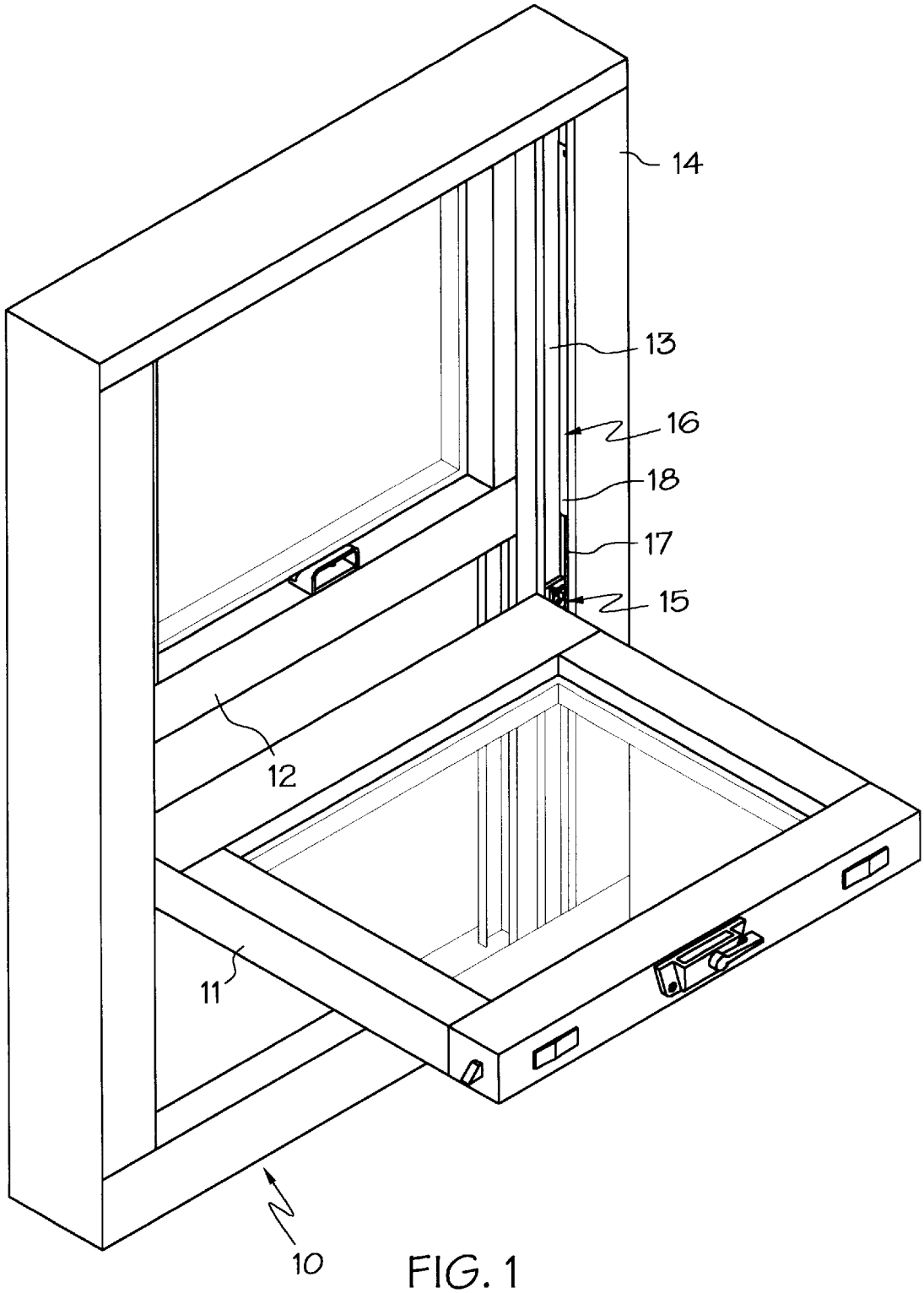
FIG. 1 is an environmental view of a double hung window with balance shoe assemblies of the invention forming a part thereof.

With reference to FIG. 1, there is shown a double hung window having a lower sash window 11 and an upper sash window 12. The sash windows are mounted in vertical slide tracks 13 found on each side of a window frame 14 for vertical sliding movement. In accordance with this invention, a balance shoe assembly 15 of the invention is mounted in the slide tracks so as to be in operable association with each lower corner of each sash window 11 and 12. Each balance shoe assembly is connected to a balance mechanism 16 mounted in the slide track of the window frame and also connected to a pivot bar mounted in a lower frame rail corner of each sash window. The balance mechanism is conventional. It includes a spiral rod 17 which extends into a stationary guide tube 18. The guide tube 18 itself is secured at a top end to the window frame's slide track by a screw or other attachment means. While not shown, a tension spring within the tube 18 is operably connected to the spiral rod 17 to produce a counter force to the weight of the window. The pivot bar is also conventional. It is horizontally mounted in the lower frame rail to rotate about its longitudinal axis. One end is rectangular-shaped when viewed transverse to its longitudinal axis. It is made of a rigid material capable of withstanding a twisting force and capable of withstanding the weight of the sash window.

Figure 2:
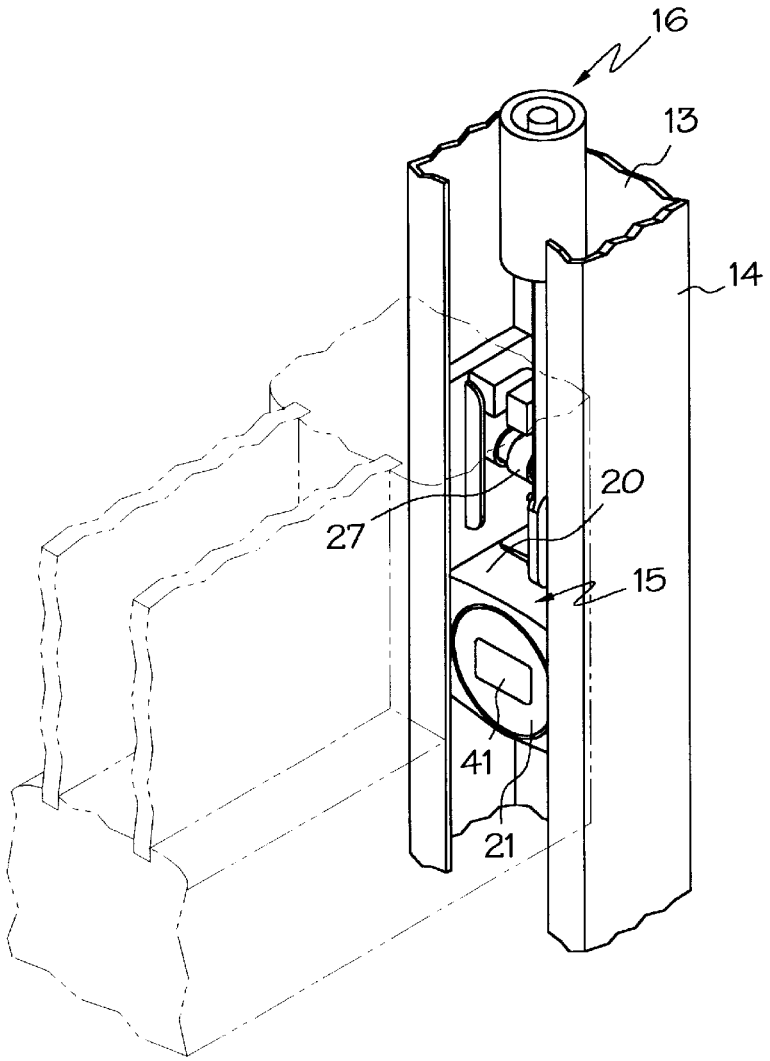
FIG. 2 is a partial view in side perspective of a balance shoe assembly of FIG. 1 showing its placement in a slide track of the window frame and its engagement to a balance mechanism.

As best seen in FIG. 2, the balance shoe assembly 15 is mounted for sliding movement in the slide track 13. A balance shoe assembly 15 on each side of the sash window rides up and down in the slide track in concert with the sash window. While not shown, an end of the pivot bar which is mounted in the sash window lower frame rail extends laterally therefrom. A terminus of the pivot bar fits into the center cam of the balance shoe mechanism and forces the whole shoe assembly to move up or down with the pivot bar and the associated sash window. As should be evident, other balance mechanisms can be used with the balance shoe assembly of the invention. Pivot bars of various designs and various sash window attachment methods can also be used.

Figure 3:
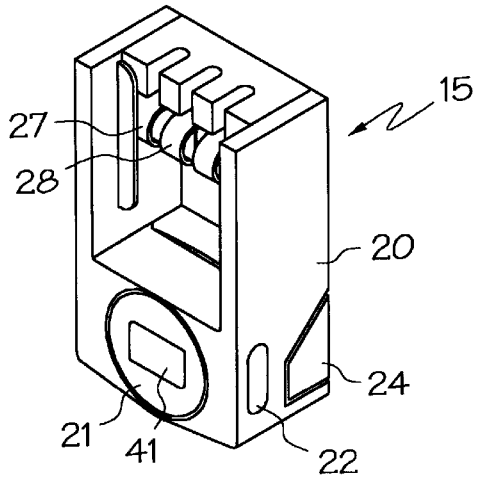
FIG. 3 is a side view in perspective of the balance shoe assembly of FIG. 2 isolated from the slide track of the window frame.
Figure 4:
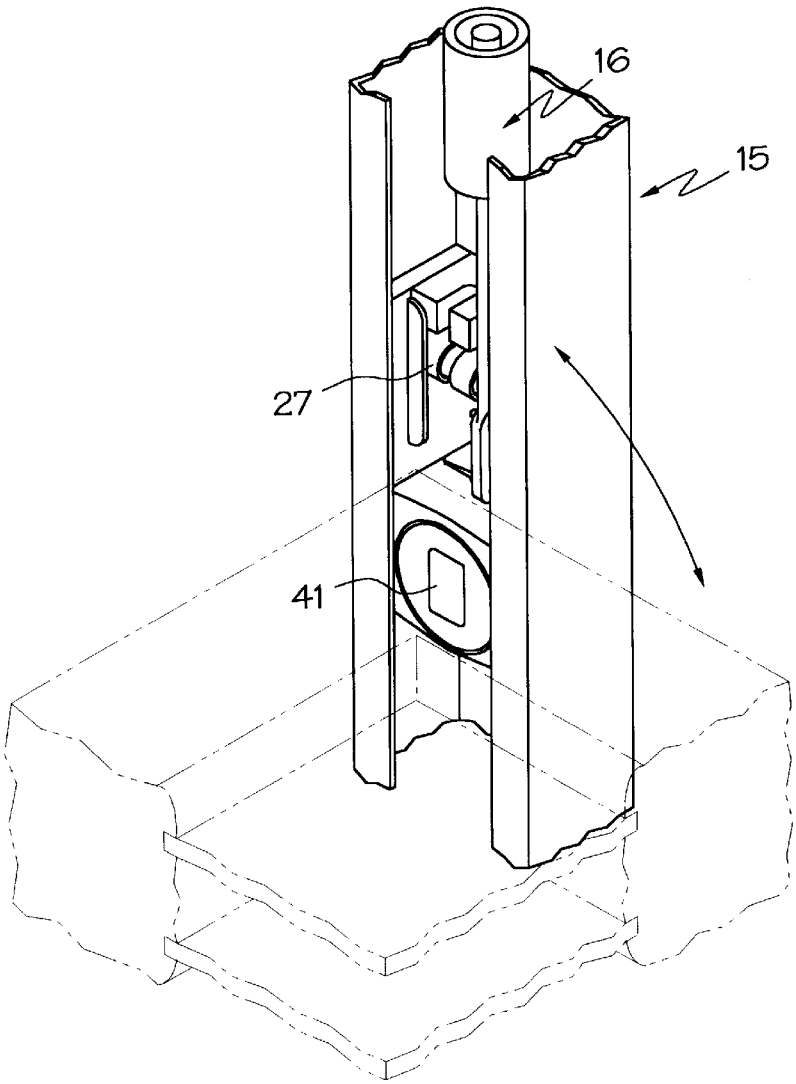
FIG. 4 is a side view in perspective of the balance shoe assembly of FIG. 1 showing movement of its center cam to a locking position.
Figure 5:
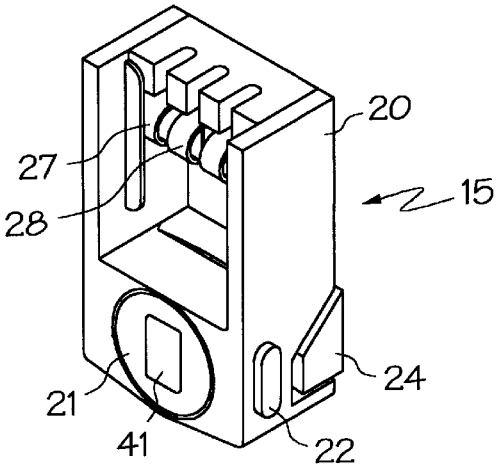
FIG. 5 is a side view in perspective of the balance shoe assembly of FIG. 4 isolated from the slide track of the window frame and wherein its brake shoes and locking lug are moved outwardly for a locking action.
Figure 6:
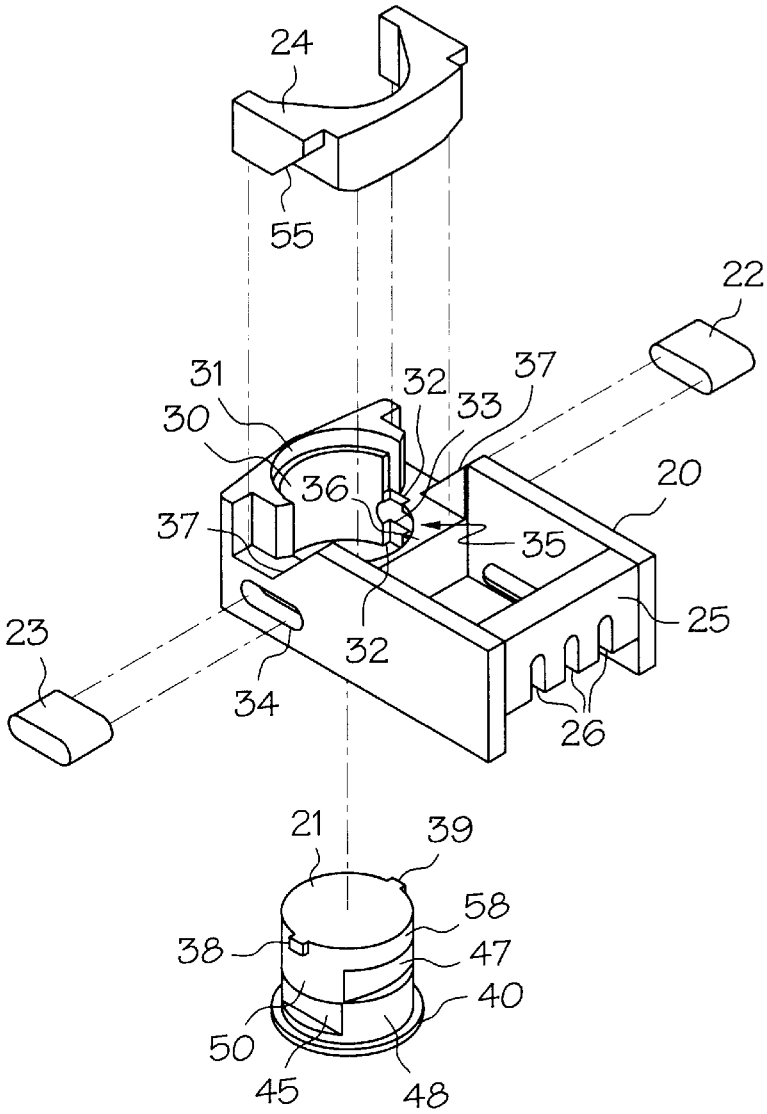
FIG. 6 is an exploded view of the balance shoe assembly of FIG. 1.
Figure 7:
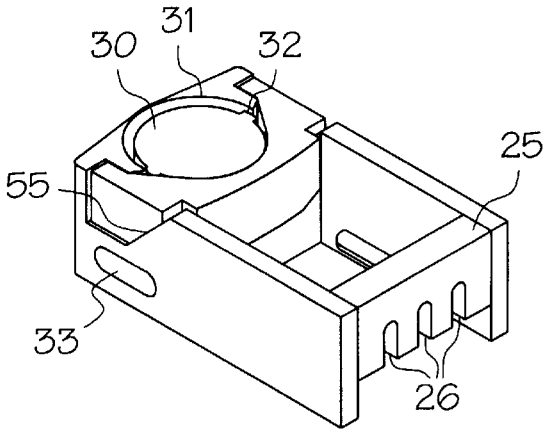
FIG. 7 is a back plan view in perspective of the balance shoe assembly of FIG. 1.
Figure 8:
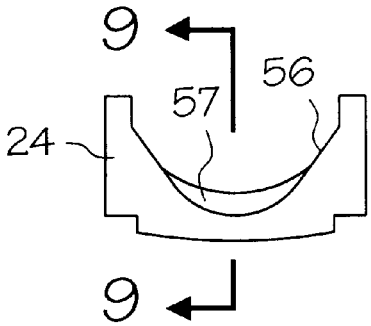
FIG. 8 is a back plan view of the locking lug used in the balance shoe assembly of FIG. 1.
Figure 9:
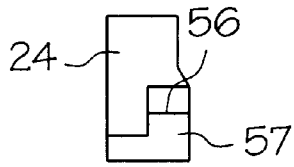
FIG. 9 is a side view in section of the locking lug of FIG. 8 taken along line 9—9 thereof.
Figure 10:
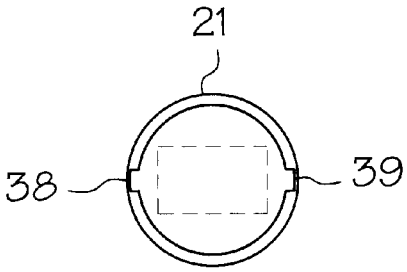
FIG. 10 is a back plan view of a center cam of the balance shoe assembly of FIG. 1.
Figure 11:
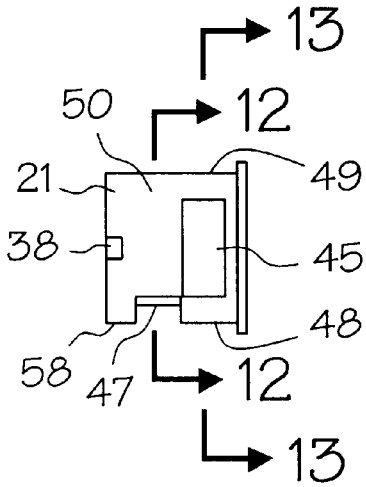
FIG. 11 is a side view of the center cam of FIG. 10.
Figure 12:
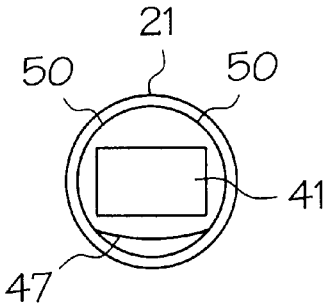
FIG. 12 is a view in section of the center cam of FIG. 11 taken along line 12—12 thereof showing a cam flat for the locking lug.
Figure 13:
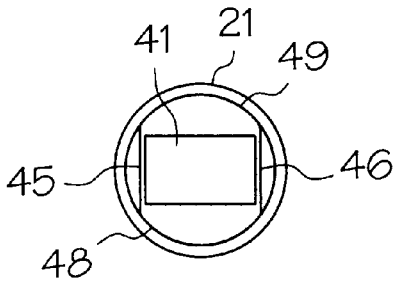
FIG. 13 is a view in section of the center cam of FIG. 11 taken along line 13—13 thereof showing two cam flats for the brake shoes.

The balance shoe assembly 15 of the invention is best described with reference to FIGS. 2–7. FIG. 2 shows the balance shoe assembly 15 in a movable position in the slide track 13 of the window frame 14 with a portion of the balance mechanism 16. FIG. 3 shows the assembly 15 of FIG. 2 in isolation. FIG. 4 shows the balance shoe assembly 15 in a locked position in the slide track of the window frame, again only with a portion of the balance mechanism 16. FIG. 5 shows the assembly 15 of FIG. 4 in isolation. FIG. 6 is an exploded view of the balance shoe assembly 15. FIG. 7 shows a back side view of the balance shoe assembly 15.

With reference to FIGS. 2–7, the balance shoe assembly comprises a slide block 20, a center cam 21, a set of brake shoes 22 and 23, and a locking lug 24. The slide block 20 as evident in FIGS. 2 and 4 is dimensioned to fit into the slide track 13 and slide along an open channel formed by the window frame's back wall, side walls and front ledges. The slide block 20 is generally rectangular-shaped when viewed transverse to its longitudinal axis. It preferably is made of a rigid plastic and can be made by a molding process.

As best seen in FIGS. 6 and 7, the slide block 20 has a head portion 25 which contains at least one retention slot and as shown three retention slots 26. The retention slots 26 are available to receive the spiral rod 17 of the balance mechanism 16 and hold it to the balance shoe assembly 15. A shaft of the spiral rod is received in one of the retention slots 26. An inverted T-shaped terminus of the spiral rod fits under side walls of the slots 26. As shown, three slots 26 are in the head portion of the sliding block 20 to provide a degree of adjustment for the spiral rod. Preferably, a wear plate 27 (seen in FIGS. 2–5) is secured to the slide block on the underside of the retention slot 26 area. The wear plate is made of a durable wear resistant material such as steel to withstand the movement and torque forces of the spiral rod during normal use of the sash windows. It preferably has inwardly curved arms 28 to retain the spiral rod's inverted T-shaped terminus.

Still with reference to FIG. 6, the slide block 20 has a lower approximately centered hole 30. The hole is cylindrical-shaped and extends from a front face of the slide block to a back face of the sliding block. A recess 31 extending around the lower periphery of the hole receives ears of the center cam 21 as further discussed below and allows them to ride along the recess as the center cam 21 rotates. A set of keyways 32 extending radially from the centered hole are to receive ears found on the center cam. Further, the slide block 20 has a first brake shoe side aperture 33 and a second brake shoe side aperture 34. The side apertures 33 and 34 extend fully from the centered hole 30 through the slide block walls. A locking lug opening 35 is found in the back face of the slide block 20 and extends to the centered hole 30. The opening 35 is defined by a substantially flat interior platform 36 and slanted side walls 37 extending from the platform 36 to the back face of the slide block. The slanted walls serve as ramps for the locking lug. The centered hole 30 receives the center cam 21, the first and second side apertures 33 and 34 receive the brake shoes 22 and 23 and the opening 35 receives the locking lug 24, all as described in the immediately following paragraphs.

The center cam 21 of the balance shoe assembly 15 is best seen in FIGS. 6 and 9–13. The center cam 21 is cylindrical-shaped and is dimensioned to rotatably fit into the centered hole 30 of the slide block 20. The center cam 21 has a set of ears 38 and 39 on a back side. The ears 38 and 39 are used to guide the center cam into the sliding block centered hole 30 through the keyways 32 during assembly and serve to hold the center cam in place during use of the balance shoe assembly 15. The center cam also has a peripheral lip 40 on its front face to retain the center cam in the centered hole 30 of the slide block 20. As evident in FIGS. 2–5, 12 and 13, the center cam 21 has a slot well 41 to receive the pivot bar terminus. The slot well 41 is in the approximately center area of the center cam's front face and extends into the center cam along its axial axis. The slot well is rectangular-shaped to receive the similarly shaped pivot bar terminus.

As best seen in FIGS. 6, 11, 12 and 13, the center cam 21 has cam flats and cam rounds. They are in operable association with the brake shoes and the locking lug. Opposed cam flats 45 and 46 receive the brake shoes. A centered cam flat 47 receives the locking lug. The cam flats allow the brake shoes and the locking lug to recede into the slide block 20 when the sash window is slid up or down. Opposed cam rounds 48 and 49 force the brake shoes partially through the side apertures while the centered cam round 50 forces the locking lug partially through the receiving opening.

The brake shoes 22 and 23 shown in FIG. 6 are dimensioned to fit in the side apertures 33 and 34 of the slide block 20. They are dimensioned to be fully contained within the slide block 20 when they contact the cam flats 45 and 46 of the center cam 21. The brake shoes extend slightly beyond the slide block side walls when they are in contact with the cam rounds 48 and 49 of the center cam 21 (as seen in FIG. 5). It should be evident that the brake shoes make friction contact with the walls of the window frame's slide track to provide a locking braking action.

The locking lug 24 of the balance shoe assembly 15 is best seen in FIGS. 6–9. The locking lug 24 is dimensioned to fit into the receiving opening of the slide block 20. It is C-shaped. Each leg of the lug has a side ramp 55 to allow the lug 24 to ride up and down the slanted side walls 37 of the opening 35 in response to rotation of the center cam 21. An inside side wall 56 of the locking lug engages the centered cam flat 47. A recessed ledge 57 in the side wall of the locking lug 24 receives a side wall 58 of the center cam 21 which is located directly about the centered cam flat 47 of the center cam 21. Upon rotation of the center cam 21, the center cam round 50 contacts the side wall 56 of the locking lug 24 and forces the ramps 55 of the lug 24 to ride upwardly along the slanted side walls 37 of the slide block and to move from a flush position with the slide block back face as seen in FIG. 7 to a protruding position with the slide block back face as seen in FIG. 5. The protruding position creates friction locking of the balance shoe assembly 15 to the back wall of the window frame.

The balance shoe assemblies are readily installed in the slide tracks of a window frame and connected to pivot bars associated with the sash windows. The windows easily move up and down within the slide track. As desired, a lower or upper sash window is moved to a desired height position in anticipation of being tilted inwardly. Release tabs on top of each sash window are moved to free a top portion of the sash window and the window is pulled downwardly. This movement causes the pivot bars in the sash window to rotate which in turn causes the center cams of the balance shoe assemblies to rotate. The cam rounds of the center cam force two brake shoes and the locking lug outwardly and into friction engagement with the slide track walls. The brake shoes exert lateral forces in opposed directions. The locking lug exerts a force in a direction transverse to the brake shoes forces. The sash window is effectively locked in position in three directions. The enhanced locking action of the balance shoes assemblies reduces stress on the window frame since the braking forces are spread over a greater area.

Having described the invention in its preferred embodiment, it should be clear that modifications can be made without departing from the spirit of the invention. It is not intended that the words used to describe the invention nor the drawings illustrating the same be limiting on the invention. It is intended that the invention only be limited by the scope of the appended claims.

I claim:

1. A tilt window balance shoe assembly for locking a window within a window frame upon rotation of a pivot bar mounted on the window, said balance shoe assembly comprising:

(a) a rigid slide block having (i) a head portion with at least one retention slot to receive and hold a balance mechanism for the window, (ii) a horizontally approximately centered hole, said horizontally approximately centered hole extending from a front face of said slide block to a back face of said slide block (iii) a side aperture in each side of said slide block, each said side aperture extending to the horizontally approximately centered hole, and (iv) an opening in the back face of said slide block extending to the horizontally approximately centered hole;

(b) a center cam having a generally cylindrically shaped outer surface and positioned in the horizontally approximately centered hole of the slide block, said center cam having a front face with a slot well to receive the pivot bar, said outer surface including brake shoe cam flats, a locking lug cam flat, brake shoe cam rounds and a locking lug cam round;

(c) two brake shoes, with each one of the brake shoes slidably positioned in a respective one of the side apertures of the slide block, and said two brake shoes in operable association with the brake shoe cam rounds of the center cam for exerting a locking force against the window frame; and (d) a locking lug positioned in the opening of the slide block and in operable association with the locking lug cam round of the center cam for exerting a locking force against the window frame, wherein when said brake shoes and said locking lug are engaged with said brake shoe cam flats and said locking lug cam flat, respectively, said brake shoes and said locking lug are in a free window movement position and when said brake shoes and said locking lug are engaged with said brake shoe cam rounds and said locking lug cam round, respectively, said brake shoes and said locking lug are in a locking position for locking the window within the window frame.

2. The tilt window balance shoe assembly of claim 1 wherein the center cam further has a pair of oppositely ears disposed on a back side of said center cam and the slide block has a pair of guide keyways to allow the ears of the center cam to pass through said slide block and further said back face of the slide block has a recess wherein said center cam ears ride along the recess of said slide block as the center cam rotates during use.

3. The tilt window balance shoe assembly of claim 2 further wherein the center cam has a peripheral lip on the front face of the center cam and said front face of the slide block has a recess which receives the peripheral lip and holds the center cam in position during use.

4. The tilt window balance shoe assembly of claim 1 wherein the opening in the slide block is defined by a platform wall and two slanted side walls extending therefrom.

5. The tilt window balance shoe assembly of claim 4 wherein the locking lug is C-shaped with a first leg having a side wall, a second leg having a side wall and a third leg connecting the first leg to the second leg to form the C-shaped locking lug and further said first leg has a ramp in its side wall and said second leg has a ramp in its side wall and said locking lug further has a recessed ledge which is engageable with the locking lug cam flat of the center cam.

6. The tilt window balance shoe assembly of claim 1 further wherein the slide block has a wear plate mounted under the at least one retention slot in the head portion thereof.

7. A tilt window balance shoe assembly for locking a window within a window frame upon rotation of a pivot bar mounted on the window, said balance shoe assembly comprising:

(a) a slide block having (i) a head portion with at least one retention slot to receive and hold a balance mechanism for the window, (ii) a horizontally approximately centered generally cylindrical-shaped hole, said horizontally approximately centered generally cylindrical-shaped hole extending from a front face of said slide block to a back face of said slide block (iii) a side aperture in each side of said slide block, each said side aperture extending to the horizontally approximately centered generally cylindrical-shaped hole, and (iv) an opening in the back face of said slide block extending to the horizontally approximately centered generally cylindrical-shaped hole;

(b) a center cam having a generally cylindrical shaped outer surface and positioned in the horizontally approximately centered generally cylindrical-shaped hole of the slide block, said center cam having a slot well to receive the pivot bar, said outer surface including two brake shoe cam flats, a locking lug cam flat axially offset from said two brake shoe cam flats, brake shoe cam rounds and a locking lug cam round;

(c) two brake shoes, with each one of the brake shoes slidably positioned in a respective one of the side apertures of the slide block, and said two brake shoes in operable association with the brake shoe cam rounds of the center cam for exerting lateral locking forces against the window frame; and (d) a locking lug positioned in the opening of the slide block and in operable association with the locking lug cam round of the center cam for exerting a locking force against the window frame which is transverse to said lateral locking forces, wherein when said brake shoes and said locking lug are engaged with said brake shoe cam flats and said locking lug cam flat, respectively, said brake shoes and said locking lug are in a free window movement position and when said brake shoes and said locking lug are engaged with said brake shoe cam rounds and said locking lug cam round, respectively, said brake shoes and said locking lug are in a locking position for locking the window within the window frame.

8. The tilt window balance shoe assembly of claim 7 wherein the center cam further has a pair of oppositely extending ears disposed on a back side of said center cam and the slide block has a pair of guide keyways to allow the ears of the center cam to pass through said slide block and further said back face of the slide block has a recess wherein said center cam ears ride along the recess of said slide block as the center cam rotates during use.

9. The tilt window balance shoe assembly of claim 8 further wherein the center cam has a peripheral lip on a front face of the center cam and said front face of the slide block has a recess which receives the peripheral lip and holds the center cam in position during use.

10. The tilt window balance shoe assembly of claim 7 wherein the opening in the slide block is defined by a platform wall and two slanted side walls extending therefrom.

11. The tilt window balance shoe assembly of claim 10 wherein the locking lug is C-shaped and further has a recessed ledge which is engageable with the locking lug cam flat of the center cam.

12. A tilt window balance shoe assembly for locking a window within a window frame upon rotation of a pivot bar mounted on the window, said balance shoe assembly comprising:

(a) a slide block having (i) a head portion with at least one retention slot to receive and hold a balance mechanism for the window, (ii) a horizontally approximately centered generally cylindrical-shaped hole, said horizontally approximately centered generally cylindrical-shaped hole extending from a front face of said slide block to a back face of said slide block (iii) a side aperture in each side of said slide block, each said side aperture extending to the horizontally approximately centered generally cylindrical-shaped hole, and (iv) an opening on the back face of said slide block extending to the horizontally approximately centered generally cylindrical-shaped hole;

(b) a center cam having a generally cylindrically shaped outer surface and positioned in the horizontally approximately centered generally cylindrical-shaped hole of the slide block, said center cam having a front face which includes a slot well to receive the pivot bar and a peripheral lip to retain said center cam in the horizontally approximately centered generally cylindrical-shaped hole, said outer surface of said center cam having two brake shoe cam flats, a locking lug cam flat axially offset from said two brake shoe cam flats, opposed brake shoe cam rounds, and a locking lug cam round located opposite the locking lug cam flat;

(c) two brake shoes, with each one of the brake shoes slidably positioned in a respective one of the side apertures of the slide block, and said two brake shoes in operable association with the opposed brake shoe cam rounds of the center cam for exerting lateral locking forces against the window frame; and (d) a locking lug positioned in the opening of the slide block and in operable association with the locking lug cam round of the center cam for exerting a locking force against the window frame which is transverse to said lateral locking forces, wherein when said brake shoes and said locking lug are engaged with said brake shoe cam flats and said locking lug cam flat, respectively, said brake shoes and said locking lug are in a free window movement position and when said brake shoes and said locking lug are engaged with said brake shoe cam rounds and said locking lug cam round, respectively, said brake shoes and said locking lug are in a locking position for locking the window within the window frame.

13. The tilt window balance shoe assembly of claim 12 wherein the center cam further has a pair of oppositely extending ears disposed on a back side of said center cam and the slide block has a pair of guide keyways to allow the ears of the center cam to pass through said slide block and further the back face of the slide block has a recess wherein said center cam ears ride along the recess of said slide block as the center cam rotates during use.

14. The tilt window balance shoe assembly of claim 13 wherein the front face of the slide block has a recess which receives the peripheral lip of the center cam to hold said center cam in position within the horizontally approximately centered generally cylindrical-shaped hole of the slide block during use.

15. The tilt window balance shoe assembly of claim 12 wherein the slide block is made of a rigid plastic.

* * * * *